United States Patent [19]

Bradshaw et al.

[11] 4,419,175

[45] Dec. 6, 1983

[54] LAMINATING DEVICE FOR LETTERED TAPE

[75] Inventors: Franklin C. Bradshaw, Scottsdale, Ariz.; Thomas P. Connoy, Lino Lakes, Minn.

[73] Assignee: Kroy Inc., St. Paul, Minn.

[21] Appl. No.: 363,015

[22] Filed: Mar. 29, 1982

[51] Int. Cl.[3] ..... B32B 31/00

[52] U.S. Cl. ..... 156/554; 156/555; 225/34; 226/181; 226/184

[58] Field of Search ..... 156/523, 527, 577, 554, 156/555; 225/34; 226/181-184, 194, 196

[56] References Cited

U.S. PATENT DOCUMENTS

| | | | |
|---|---|---|---|
| 2,487,061 | 11/1949 | Ptasnik | 225/34 X |
| 2,495,389 | 1/1950 | Sammann | 225/34 X |
| 2,796,110 | 6/1957 | Dahlberg | 156/577 X |
| 3,340,130 | 9/1967 | Dunn et al. | 156/555 X |
| 3,586,587 | 6/1971 | Boyce | 156/577 X |
| 3,620,467 | 11/1971 | Isom | 226/181 X |
| 3,642,229 | 2/1952 | Downey et al. | 226/194 X |

*Primary Examiner*—David A. Simmons
*Attorney, Agent, or Firm*—Dorsey & Whitney

[57] ABSTRACT

A device for laminating a piece of adhesive coated laminating tape onto a section of lettered tape comprising a housing having a first roller rotatably mounted between the side walls of the housing, a second roller rotatably mounted between the side walls of the housing, a supply of adhesive coated tape rotatably mounted within the housing and rearwardly of the first and second rollers, a guide for guiding a section of the lettered tape toward the laminating station and a cut-off edge for severing the adhesive coated tape.

17 Claims, 9 Drawing Figures

LAMINATING DEVICE FOR LETTERED TAPE

BACKGROUND OF THE INVENTION

The present invention relates generally to a device for laminating a first section of adhesive coated tape onto a second section of tape, and more particularly, to a device for laminating an adhesive coated layer of tape to the top surface of a piece of lettering tape or the like for improving the durability of the same.

Various printing apparatus and devices exist in the prior art for producing a strip of lettering tape having lettered characters or other indicia thereon. One example one such an apparatus is the device described in U.S. Pat. No. 4,243,332 which utilizes a dry lettering process to transfer an image of a character from a carbon ribbon onto a section of adhesive coated tape with a release liner. When it is desired to use this lettered tape, the release liner is removed and the adhesive coated top layer which carries the letters is placed on the desired medium. The tape and ribbion supply for use in such apparatus is described in U.S. Pat. No. 4,226,547. Although lettering devices of the type described above produce high quality lettering with sufficient durability for many applications, there are some applications where more durability is required. For example, when the lettering tape is used on file folders, technical drawings, keylines, name tags, machines or any other application where the lettering is exposed to constant handling or abrasion, the lettering tends to wear down, smudge, scratch of the like. Accordingly, in certain applications, it is desirable to provide such lettering with greater durability.

In the past, several options were available to accomplish this objective. One option was simple to manually place a strip of adhesive coated, transparent tape over the lettered tape after it had been placed on the desired medium. This worked sufficiently well, although it was difficult to accurately align the adhesive coated tape with the lettered tape. A second option was to spray the lettered tape with a clear lacquer or to apply a layer of a varnish-type shellac to the lettered tape with a brush. Although this option was acceptable for some applications, it was time consuming. Also, the application of the lacquer or the shellac sometimes caused the lettering to smudge or partially dissolve, thus adversely affecting the quality of the resulting product. A third option was to laminate the lettered tape between two sheets of plastic and bond the same together with a heat seal. This also was quite time consuming and was only applicable for very limited situations.

Accordingly, a need exists in the art for a means for quickly and efficiently increasing the durability of lettered tape.

SUMMARY OF THE INVENTION

In contrast to the prior art, the present invention relates to an inexpensive, quick and efficient means for substantially improving the durability of a section of lettering tape. More specifically, this means includes a laminating device which functions to laminate a piece of adhesive coated tape onto the top surface of a section of lettering tape following the lettering step, but prior to placement of the lettering tape onto the desired medium. Preferably, the adhesive coated tape which is laminated onto the lettering tape is the same width as the lettering tape and is transparent. The laminating device includes a supply of adhesive coated laminating tape, a pair of laminating rollers, and a guide means for guiding a section of lettered tape into a position in which the laminating tape can be laminated onto the top surface of the lettering tape. Means is also provided for severing the laminating tape after completion of the laminating step. In one embodiment of the present invention, a first roller is constructed from a relatively hard material such as aluminum or plastic and includes a pair of beveled edges extending outwardly from the cylindrical surface of such roller at an angle greater than 90°. In this embodiment, additional means are provided for guiding the lettered tape into laminating alignment with the rollers and insuring such alignment during the laminating procedure. In a second embodiment of the invention, the first roller constructed of a relatively hard material includes a pair of side edges which extend radially outwardly from the generally cylindrical surface of the roller at approximately 90°. It has been found that with this embodiment, additional guide means for the lettered tape is unnecessary. Both embodiments contemplate the use of a second cooperating roller constructed of a rubbery material and adapted for close association with the generally cylindrical outer surface of the first roller. The device also includes a removable housing section for refilling the supply of adhesive coated tape.

Accordingly, it is an object of the present invention to provide a device for improving the durability of lettered tape or the like.

Another object of the present invention is to provide a device for improving the durability of lettered tape prepared via a dry lettering process.

Another object of the present invention is to provide a laminating device for laminating a piece of adhesive coated tape onto the top surface of a section of lettered tape.

A further object of the present invention is to provide a tape laminating device having means for insuring exact and accurate lamination of the laminating tape onto a section of lettered tape.

These and other objects of the present invention will become apparent with reference to the drawings, the description of the preferred embodiment and the appended claims.

DESCRIPTION OF THE PREFERRED EMBODIMENT

Figure 1:
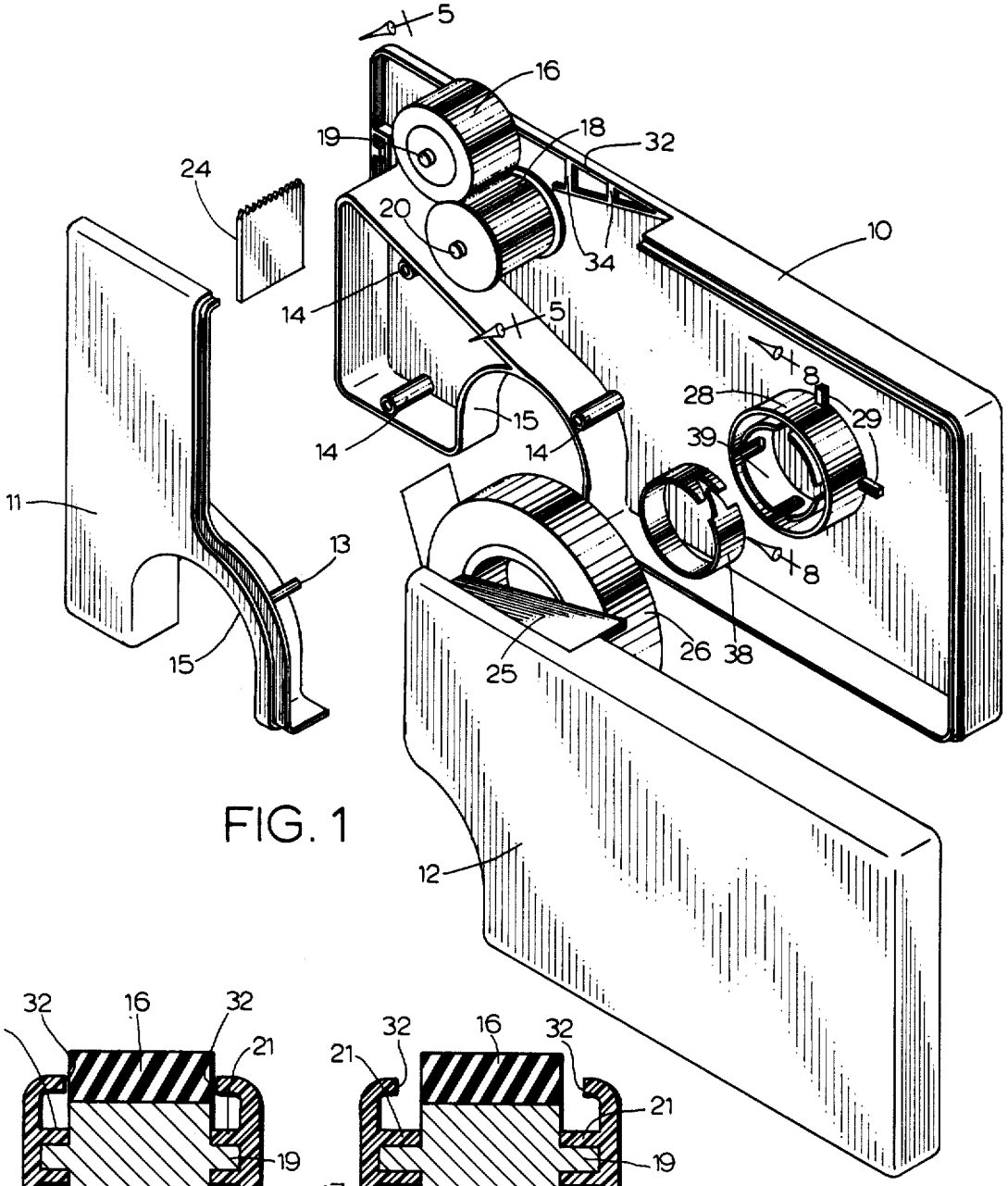
FIG. 1 is a pictorial view of the laminating device of the present invention which has been broken apart to show the various elements of the device.

Reference is first made to FIG. 1 showing a pictorial view of the laminating device of the present invention which has been broken apart to show the various individual parts. The laminating device includes a housing having a pair of side walls and top, bottom, front and rear edges, a pair of laminating rollers 16 and 18 defining a laminating station, a supply of laminating tape 26 and a section of tape 30 to be laminated. The housing is comprised of a main housing element 10 and forward and rearward cover sections 11 and 12, respectively. The housing element 10 includes a plurality of alignment holes or openings 14 which are adapted for engagement by corresponding alignment posts 13 (only one being illustrated in FIG. 1) positioned on the inside surface of the cover section 11. When assembled, the alignment posts 13 are inserted into the openings 14 and the forward cover section 11 is secured to the main housing element 10 by sonic welding or other appropriate connection means. The rearward cover section 12 is configured to match with a rearward edge of the forward cover section 11 and is also adapted for connection with the main housing element 10. The specific connection means for retaining the rearward cover section 12 in operative engagement with the housing element 10 is a connection means which enables the section 12 to be selectively removed to refill the housing with a supply of tape. The details of this connection means will be described below with reference to FIGS. 1 and 8. When assembled, the laminating device includes a recessed area 15 to facilitate easy manual holding of the unit.

Each of the generally cylindrical laminating rollers 16 and 18 is rotatably mounted between the main housing element 10 and the forward cover section 11 about an axis generally perpendicular to the housing side walls. As shown best in FIGS. 1 and 5, the rollers 16 and 18 include mounting posts 19 and 20, respectively, which extend outwardly from each side of the rollers 16 and 18 for engagement with corresponding boss elements 21 and 22 formed on the inside surface of the housing element 10 and the forward cover section 11. In the preferred embodiment, the posts 19 on each side of the roller 16 are rotatably supported within the elements 21, while the posts 20 extending outwardly from the roller 18 are rotatably supported within the elements 22. As illustrated best in FIGS. 2 and 3 the lower roller 18 is positioned rearwardly of the roller 16 to permit the lettered tape 30 to be guided toward the laminating station, defined by the juncture between the rollers 16 and 18, from the top edge of the housing. It can also be seen in FIGS. 2 and 3 that a portion of the top roller 16 extends above the top edge of the laminator housing. This facilitates manual rotation of the roller 16 for commencing the laminating procedure. It is contemplated that the roller 16 could be entirely below the top edge of the housing provided the roller 16 is accessible for manual rotation.

Figure 5:
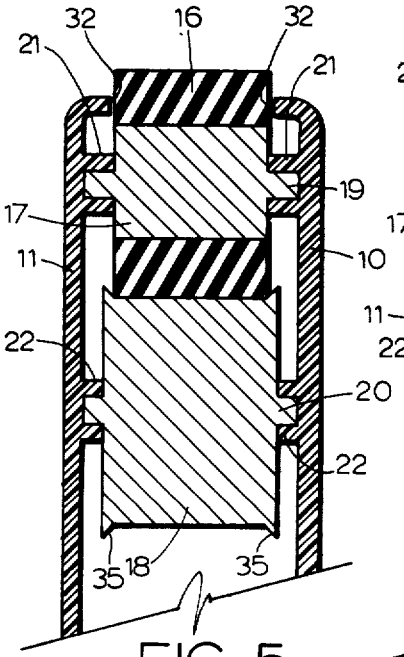
FIG. 5 is a view, partially in section, as viewed through the section line 5—5 of FIG. 1.
Figure 6:
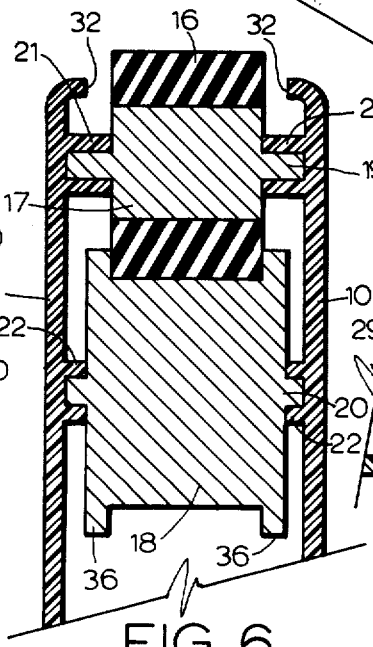
FIG. 6 is a view, similar to the view of FIG. 7, showing a second embodiment of a roller construction.

Reference is next made to FIGS. 5 and 6 which illustrate two embodiments of roller configurations. In FIG. 5, the top roller 16 includes a centrally positioned cylindrical portion 17 and an outer annular portion constructed of a rubbery material. While this outer portion of the roller 16 can be constructed of a variety of materials, it is preferable if this roller is a silicon rubber material with a durometer between approximately 30 and 60. The roller 16 should be soft enough to eliminate the formation of any air bubbles during the lamination procedure and to achieve a press fit between the rollers 16 and 18, but hard enough to create sufficient laminating force. The lower roller 18 in FIG. 5 is constructed of a relatively hard material such as aluminum, although it is contemplated that this roller could also be constructed from other materials such as a hard plastic or the like. As illustrated, this roller 18 is wider than the roller 16 and includes outwardly extending beveled edges 35, 35. These edges extend radially and axially outwardly from the main cylindrical portion of the roller 18 and also outwardly from the roller 16 in the manner shown. The purpose of these beveled edges 35, 35 is to assist in maintaining proper alignment between the adhesive coated tape 26 and the lettered tape 30. This particular roller construction assists in guiding the adhesive coated tape 26 into exact laminating alignment with respect to the tape section 30. In the preferred embodiment, the angle which the beveled edges 35, 35 make with respect to the generally cylindrical portion of the roller 18 is approximately 110°, although it is contemplated that various other angles will also be acceptable. This angle, however, should be sufficient to perform the above-mentioned guiding function. The cylindrical portion of the roller 18 is adjacent to the roller 16 to define a lamination station therebetween.

A second embodiment of a roller configuration is illustrated in FIG. 6. The principal difference between the embodiment of FIG. 6 and the embodiment of FIG. 5 is that the bottom roller 18 of FIG. 6 includes side flange portions 36, 36 which extend radially outwardly from each side of the generally cylindrical portion of the roller 18 at approximately right angles. These flange portions 36, 36 also extend for a limited distance on each side of the roller 16. It has been found that when this roller configuration is used, the guiding and alignment of the tape section 30 and the laminating tape 26 is accomplished entirely by the roller configuration itself, thereby eliminating the need for any alignment function to be performed by alignment edges of the housing which is necessary with the embodiment of FIG. 5. The outer flange portions 36, 36 extend radially outwardly from the generally cylindrical portion of the roller 18 a distance sufficient to insure proper alignment of the adhesive coated tape 26 and the lettered tape 30 during their movement toward and away from the laminating station. It should be noted that in the embodiments of both FIGS. 5 and 6, the distance between the beveled edges 35, 35 and between the flange portions 36, 36 is the same as the width of the laminating tape 26 and the tape 30 to be laminated.

The laminating device of the present invention also includes a cut-off element 24 secured between portions of the housing element 10 and the forward cover section 11 for severing the adhesive coated tape 26 after the laminating procedure has been completed. The rearward cover section 12 includes a guide means comprising an inclined guide ramp 25 formed at the forward end of its upper edge. This ramp 25 functions to guide the lettering tape 30 which is to be laminated into laminating engagement with the rollers 16 and 18.

Figure 2:
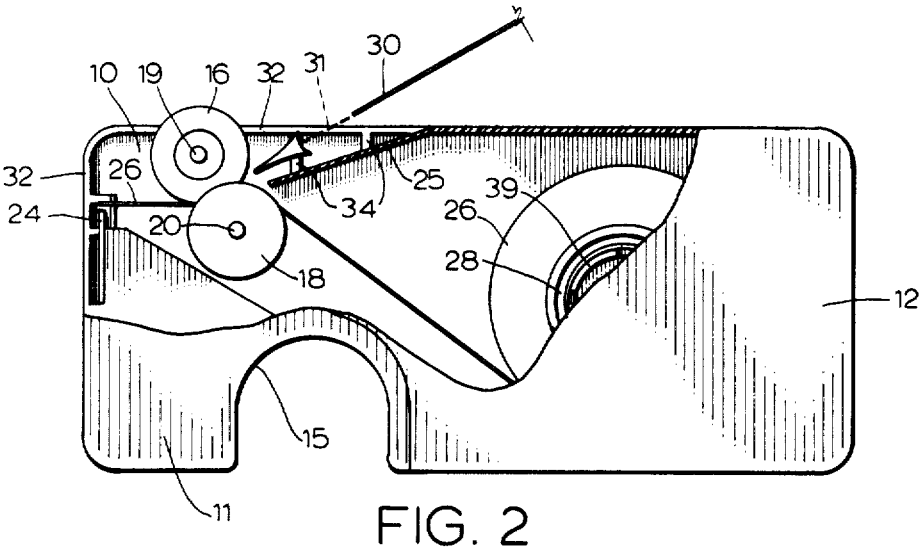
FIG. 2 is a side elevational view of the laminating device of the present invention showing a section of lettered tape as it is being introduced into the laminating station.
Figure 3:
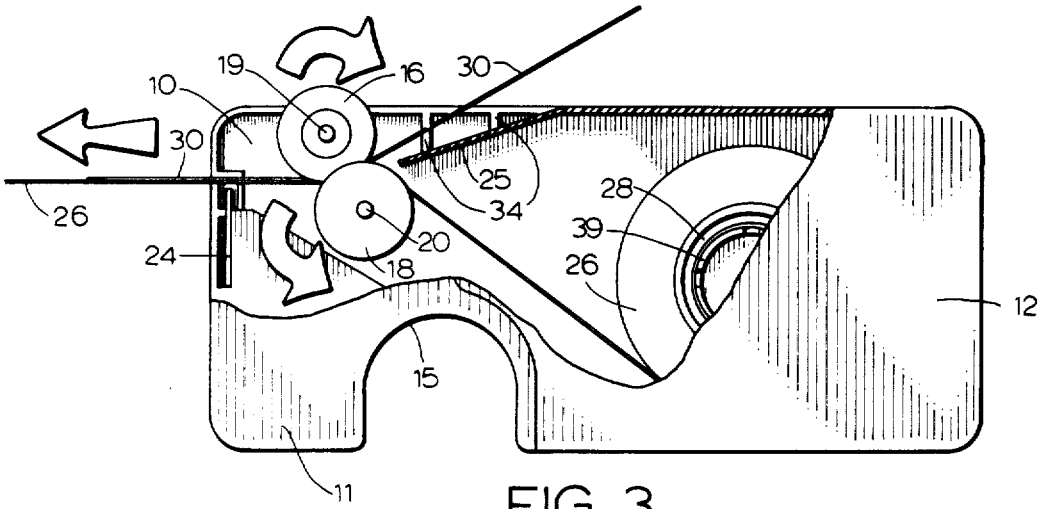
FIG. 3 is a side elevational view similar to FIG. 2 with portions broken away showing a piece of lettering tape as it is being laminated.
Figure 4:
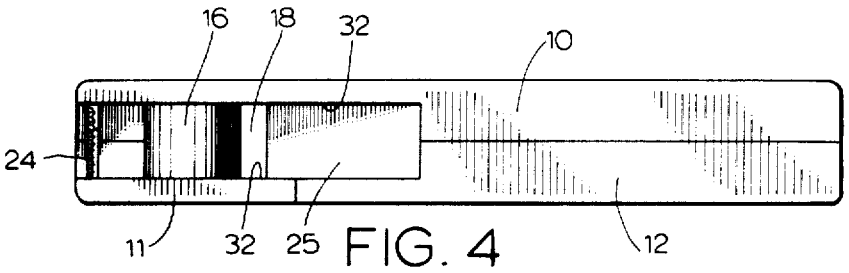
FIG. 4 is a top elevational view of the laminating device of the present invention.
Figure 7:
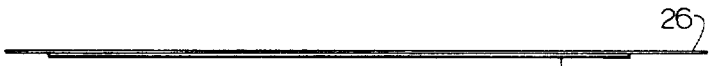
FIG. 7 is a side elevational view of a section of lettered tape which has been laminated with an adhesive coated layer of tape.

As shown in FIGS. 2 and 3, the guide ramp 25 is disposed at an angle of approximately 90° relative to a line extending through the axes of the rollers 16 and 18. It should be noted, however, that this angle can vary as long as the ramp functions to guide the tape section 30 into laminating position between the rollers 16 and 18.

The laminating device also includes a supply of adhesive coated, transparent tape 26 rotatably mounted within the device rearwardly of the rollers 16 and 18 and between portions of the housing element 10 and the rearward cover section 12. The adhesive coated tape 26 is rotatably mounted on the cylindrical portion 28 about an axis generally perpendicular to the side walls of the housing with the tape being supplied toward the laminating rollers 16 and 18 with its adhesive side facing upwardly. A plurality of spacing elements 29 are positioned between the cylindrical portion 28 and the inner surface of the housing 10 and also between a corresponding cylindrical section 37 (FIG. 8) and the inner surface of the cover section 12 to center the adhesive coated tape supply 26 to prevent the same from contacting the inner side walls of the housing element 10 and cover section 12. In the preferred embodiment, the term transparent is intended to mean both clear and matte transparent tape.

Figure 8:
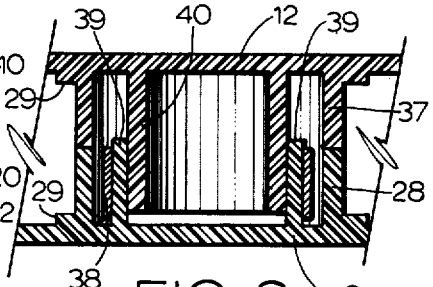
FIG. 8 is a view along the section line 8—8 of FIG. 4 showing the means for holding the housing element and the rear cover section of the laminated device together.

The means for retaining the rearward cover section 12 to the housing element 10 is illustrated best in FIGS. 1 and 8. This means includes a cylindrical section 40 integrally formed with and extending inwardly from the inner surface of the section 12, the sleeve member 39 and the compression ring 38. The sleeve member 39 is integrally joined with the inner surface of the housing member 10 and includes four flexible leaf segments extending from this inner surface in a generally cylindrical configuration. The ring 38 is disposed around the outer periphery of the sleeve 39 to bias the leaf segments inwardly. When the cover section 12 is joined with the housing member 16 as shown in FIG. 8, the cylindrical section 40 slides inside the sleeve 39 and is retained in that position as a result of the compression force of the ring 38 on the sleeve 39.

Figure 9:
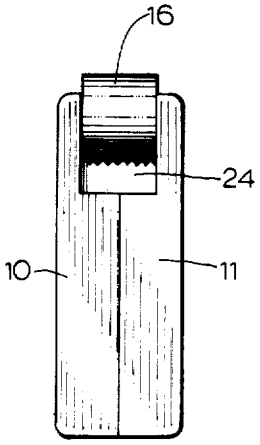
FIG. 9 is a front end elevational view of the laminating device of the present invention.

Reference is next made to FIGS. 2 and 3 which are side views of the laminating device showing such device in various stages of operation. In its normal position as illustrated in FIG. 2, the adhesive coated tape 26 extends from the supply between the rollers 16 and 18 with its adhesive side facing upwardly. When a section of lettered tape 30 is desired to be laminated, it is inserted between the laminating rollers 16 and 18 as illustrated by the directional arrow 31 in FIG. 2 with the lettered surface facing downwardly. When doing this, the guide ramp 25 functions to properly guide the lettered tape 30 into proper laminating engagement between the rollers 16 and 18. After initial engagement is made between the forward edge of the tape 30 and the rollers 16 and 18, the roller 16 is rotated in a clockwise direction using the thumb or finger of the user. This rotation causes movement of the tape 30 between the rollers 16 and 18 and results in laminating the top surface of the tape 30 with a layer of the adhesive coated tape 26. As rotation of the roller 16 continues, a point is reached when the forward edge of the tape 30 can be grasped and simply pulled through the rollers 16 and 18. When this is done, the remainder of the tape section 30 is laminated with the section of the adhesive backed tape 26. When the tape section 30 has been pulled completely through the rollers 16 and 18, the end of the adhesive coated tape 26 is cut-off by the serrated cut-off edge 24. The result is a section of the lettered tape 50 illustrated in FIG. 9, with a section of adhesive coated tape 26 laminated to its top surface. The lettered layer of the tape section 30 can then be removed in a conventional manner and placed on the desired medium. As a result of this lamination, the lettering on the lettered tape becomes moisture proof and resistent to abrasion, scratches and normal wear and tear.

With further reference to FIGS. 1–5, it can be seen that inner edge portions of the housing element 10 and the cover sections 11 and 12 define a guide edge 32 for properly aligning and guiding the lettered tape 30 toward and away from the laminating position between the rollers 16 and 18. In the preferred embodiment, the distance between this edge on the housing element 10 and the corresponding edge on the cover sections 11 and 12 is only slightly greater than the width of the tape section 30 to be laminated. Accordingly, this edge 32 functions to guide the tape section 30 toward and away from the laminated rollers 16 and 18. Additional guiding function is provided by the generally vertical guide edges 34, 34 extending downwardly from the guide edge 32 on the inside of the housing element 10. Guide edges similar to the guide edges 34, 34 are also present on the inner surface of the cover section 12 between the edge 32 and the ramp 25.

Although the description of the present invention has been quite specific, it is contemplated that various modifications could be made without deviating from the spirit of the present invention. Accordingly, it is intended that the scope of the present invention be dictated by the appended claims rather than by the description of the preferred embodiment.

We claim:

1. A hand-held device for laminating a piece of adhesive coated laminating tape onto a section of lettered tape or the like of substantially the same width comprising:

a housing having a pair of side walls and top, bottom, front and rear edges;

a first generally cylindrical roller rotatably mounted between said pair of side walls about a first fixed axis generally perpendicular to said side walls, said first roller having a portion extending above the top edge of said housing to permit manual rotation thereof and having a first cylindrical surface parallel to said first fixed axis;

a second generally cylindrical roller rotatably mounted between said pair of side walls about a second fixed axis generally perpendicular to said side walls, said second roller being positioned adjacent said first roller to define a laminating station therebetween and having a second cylindrical surface parallel to said second fixed axis, one of said first and second rollers further having a tape alignment edge extending outwardly from each end of its corresponding cylindrical surface for guiding said laminating tape and said lettered tape in laminating association with said laminating station;

a supply of adhesive coated tape rotatably mounted between said pair of side walls about an axis generally perpendicular to said side walls and rearwardly of said first and second rollers, said supply of adhesive backed tape being disposed so that said adhesive coated tape is supplied to said laminating station between said first and second rollers with the adhesive side of said adhesive coated tape facing upwardly;

guide means for guiding a section of lettering tape from said top edge toward said laminating station; and means positioned forward of said first and second rollers for severing said adhesive coated tape.

2. The device of claim 1 wherein said tape alignment edge includes a beveled edge extending generally radially outwardly from opposite ends of said second cylindrical surface at an angle greater than 90°.

3. The device of claim 2 wherein said first roller is positioned adjacent the cylindrical portion of said second roller and between said beveled edges.

4. The device of claim 3 wherein said first roller is constructed from a silicon rubber material and said second roller is constructed from a relatively hard material.

5. The device of claim 4 wherein said first roller is constructed from a material having a durometer of between about 30 and 60 and said second roller is constructed from aluminum.

6. The device of claim 2 wherein said beveled edges extend outwardly a distance sufficient to insure proper alignment of said adhesive coated tape and said lettered tape during movement past said laminating station.

7. The device of claim 1 wherein said tape alignment edge includes a side edge extending radially outwardly from opposite ends of said second cylindrical surface at an angle of about 90°.

8. The device of claim 7 wherein said first roller is positioned adjacent the cylindrical portion of said second roller and between said side edges.

9. The device of claim 8 wherein said side edges extend radially outwardly a distance sufficient to insure proper alignment of said adhesive coated tape and said lettered tape during their movement past said laminating station.

10. The device of claim 9 wherein said first roller is constructed from a rubber-like material and said second roller is constructed from a relatively hard material.

11. The device of claim 10 wherein said first roller is constructed from a material having a durometer of between about 30 and 60 and said second roller is constructed from aluminum.

12. The device of claim 1 wherein said housing includes a pair of inwardly facing side edges both forward of said first and second rollers and rearward of said first and second rollers for guiding said lettered tape toward and away from said laminating station.

13. The device of claim 1 wherein said second roller is positioned rearwardly of said first roller.

14. The device of claim 1 wherein said housing includes a removable cover portion to permit refill of said adhesive coated tape.

15. The device of claim 1 wherein said top edge of said housing includes an opening defined by spaced apart, generally parallel inner edges of said top edge, said opening permitting the extension of a portion of said first roller above said top edge of said housing and the introduction of said lettered tape into alignment with said laminating station.

16. The device of claim 1 wherein the length of said first cylindrical surface is approximately equal to the length of said second cylindrical surface.

17. The device of claim 1 wherein said guide means includes an inclined ramp element extending from the top edge of said housing toward said laminating station.

* * * * *